US005085608A

United States Patent [19]

Turner

[11] Patent Number: 5,085,608

[45] Date of Patent: * Feb. 4, 1992

[54] COLLAPSIBLE DESK WITH DOLLHOUSE

[76] Inventor: De Maris C. Turner, 7471 S. Marion, Tulsa, Okla. 74136

[ * ] Notice: The portion of the term of this patent subsequent to Apr. 24, 2007 has been disclaimed.

[21] Appl. No.: 497,240

[22] Filed: Mar. 22, 1990

Related U.S. Application Data

[60] Division of Ser. No. 273,370, Nov. 17, 1988, Pat. No. 4,919,498, which is a continuation-in-part of Ser. No. 144,048, Jan. 14, 1988, abandoned.

[51] Int. Cl.[5] ..... A63H 33/04; A63H 3/52; A47B 77/10

[52] U.S. Cl. ..... 446/75; 446/482; 312/314

[58] Field of Search ..... 446/75, 76, 71, 80, 446/476, 478, 479, 482, 487; 312/241, 245, 314, 316

[56] References Cited

U.S. PATENT DOCUMENTS

| | | | |
|---|---|---|---|
| 500,610 | 7/1893 | Pooley | 312/316 |
| 1,092,681 | 4/1914 | Way | 312/314 |
| 1,195,964 | 8/1916 | Bradley | 312/314 |
| 2,657,966 | 11/1953 | Brockway | 312/316 X |
| 2,738,249 | 3/1956 | Tenenblatt | 312/241 X |
| 3,400,485 | 9/1968 | Callin et al. | 446/76 |
| 4,057,244 | 11/1977 | Gaspar | 446/482 X |
| 4,131,227 | 12/1978 | Patton et al. | 446/76 X |
| 4,435,915 | 3/1984 | Zaruba et al. | 446/478 X |
| 4,857,028 | 8/1989 | Pail | 446/75 X |
| 4,919,498 | 4/1990 | Turner | 312/245 X |

FOREIGN PATENT DOCUMENTS

| | | | |
|---|---|---|---|
| 835421 | 12/1938 | France | 446/478 |
| 1098221 | 7/1955 | France | 446/478 |
| 2113108 | 8/1983 | United Kingdom | 446/478 |

*Primary Examiner*—David N. Muir
*Attorney, Agent, or Firm*—Head & Johnson

[57] ABSTRACT

A portable, multi-use, self-storing, wall mounted fold down desk/work center providing interior storage with applications for home, office and institutional uses. A box-like storage cavity is mounted on a wall and may be positioned at various selected heights. A single piece desk member having a flat work surface is hingedly attached at its back edge to the bottom frame of the storage cavity. First and second doors are hinged to the edge of the desk member and fold shut against the under edge of the desk member to make a compact box. When open the desk is in a horizontal position and the doors are folded to a vertical position. On one edge of each door is an extendable leg which extends to the floor to give the desk added stability. A collapsible dollhouse may be stored in its carrying case in the storage cavity. Alternatively, a vanity insert is provided so that when the desk is opened it converts into a dressing table. The unit may be a workcenter, game center or other utilitarian uses. Speed bracket mounting means are provided to accommadate different distances between wall studs. Special latching brackets have utilitarian as well as safety benefits.

3 Claims, 9 Drawing Sheets

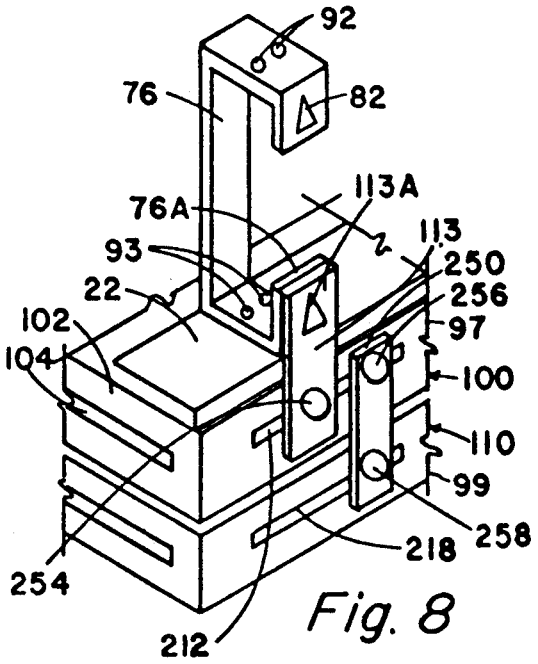
Fig. 8
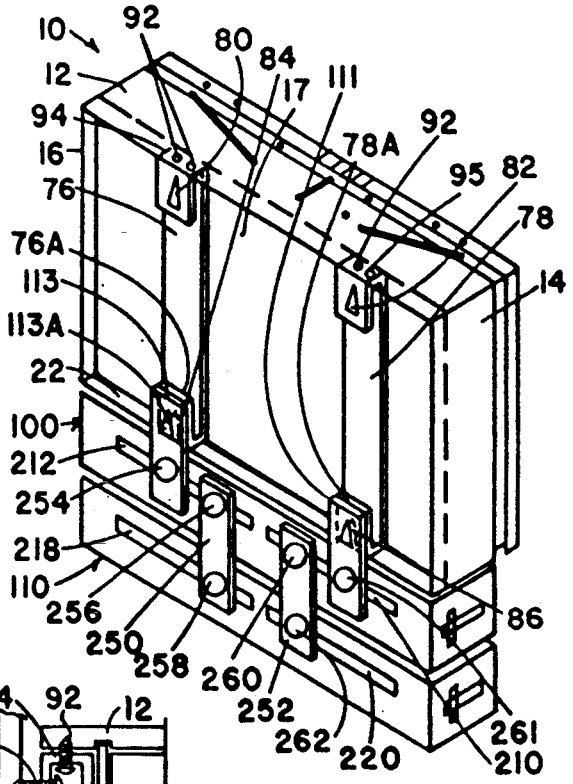
Fig. 6
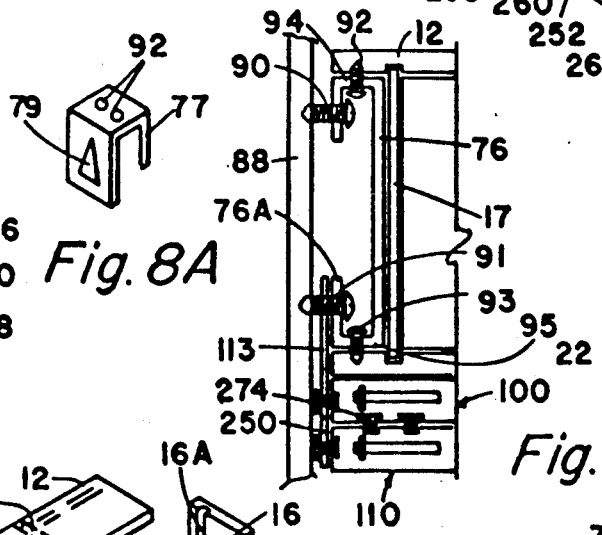
Fig. 7
Fig. 8A
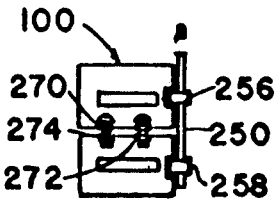
Fig. 6A
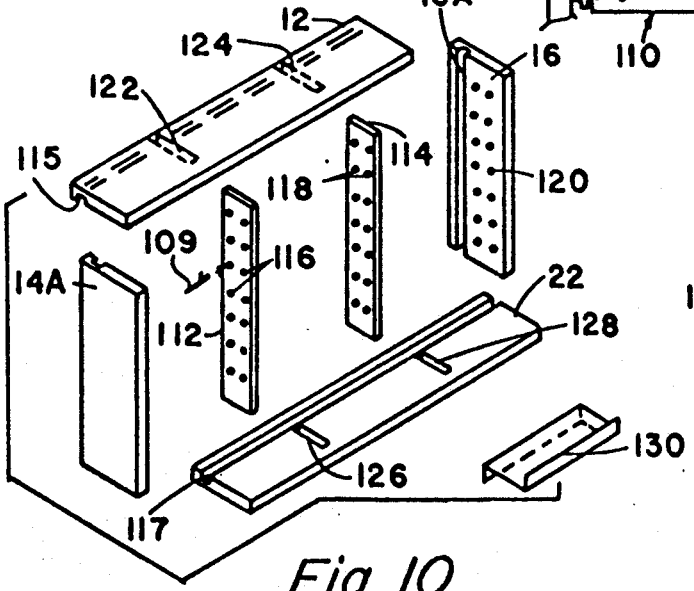
Fig. 10
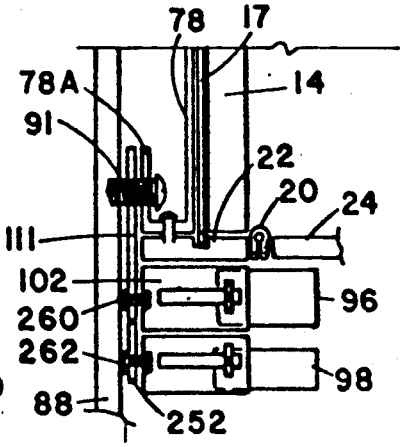
Fig. 9

COLLAPSIBLE DESK WITH DOLLHOUSE

This is a divisional of copending application(s) Ser. No. 07/273,370 filed, now U.S. Pat. No. 4,919,498 on 11/17/88 which was a continuation-in-part of Ser. No. 07/144,048, filed 01/14/88, now abandoned.

BACKGROUND OF THE INVENTION

1. Field of the Invention:

This invention relates to improvements in collapsible desk.

2. Description of the Prior Art:

Collapsible desks have been around for some time. One of the more common forms, and might be considered background of the present invention, is the kind where the frame is mounted on the wall and a desk top is hinged at the back edge so that it can go from a folded position against the wall to a horizontal position where it is useful for writing. Chains extending from the outer edge of the desk top to the wall are usually provided to give the table top support when it is used. Such structures can be used as a desk.

Various methods have been known to support a heavy object on a wall. One method is to use a bar mounted on a wall with an opening lip on the top and a bar mounted to the back of the unit with open space on the bottom so they could hold together. If this would be bumped from below the object to be hung could be knocked off easily. Another mounting system is to cut holes in the unit itself and hang it on mounting screws. However, this is not acceptable as it does not look attractive and the constant wear and tear on the wood would also damage the wood. A heavy unit must be held securely against the wall with no movement possible.

SUMMARY OF THE INVENTION

This is a collapsible, wall mounted, convertible desk-like assembly or unit which serves multiple purposes as a desk, as a vanity or dressing table, workcenter, or as a child's playhouse support.

The collapsible convertible desk assembly unit includes a box-like storage cavity having a first and second side frame, a top frame, a bottom frame and a back which is mountable on a wall. The top, bottom and sides of the box-like structure extends back beyond the back member of the box-like structure. Special bracket means are mounted to this overhang or extension of the top and the bottom and are designed such that different distances between wall studs can be accommodated. A single piece desk member having a flat work surface on one side and a flat opposite side is hingedly attached at its back edge to the front edge of the bottom frame.

A first and second door, each having a top edge, is hingedly secured to one of the side edges of the desk member when the desk member is folded to the position where it closes the box like storage cavity. The two doors may be closed so that they fit against the opposite or bottom side of the desk member. The doors may be covered with of any utilitarian material such as cork or magnetic surface so that bulletins can be pinned thereto or additional framed bulletin board, etc. may be attached to front of doors with screws. Special latching bracket means are provided to secure the desk member to the top of the box like structure. Also special latching bracket means are provided to latch the doors in a closed position against the underside of the desk member. The same bracket means can be utilized to latch the doors in a position to which the doors make either 180° angle or a 90° angle with the desk member.

Also provided are extendable legs retractable into the top edges of each door so that the door can be folded flat against the opposite side of the desk member. When the desk member is in its lower position, the doors are unfolded and the extendable legs are extended to the floor and secured in position so that they give support to the desk member. When the desk is in its lowermost position the unfolded doors may rest on the floor and serve to support the desk top and the extendable legs are not then extended. In one embodiment a drawer is supported by and under the back frame in a position such that when it is slid to its open position it gives additional support to the desk member when in the horizontal position. The collapsible convertible desk unit includes a vanity or versatile workcenter insert for inserting into the storage cavity. When the desk member is folded to a closed position, the vanity insert is between the desk member and the back of the storage cavity. When the desk member is in its open position, the vanity insert converts the desk into a dressing table thus giving it another use. A workcenter insert can include tackboard, blackboard, other shelves or trays. The vanity insert can include a mirror and a plurality of removable trays. The collapsible convertible desk unit is also provided with a still further use in that it includes a collapsible dollhouse insert which is mounted in the storage cavity between the back of the storage cavity and the top of the desk member. When the desk is opened so that the desk member is in a horizontal position, the dollhouse unit can be unfolded to form a dollhouse and the desk top forms a support for the floor of the dollhouse. When the unit completely folded up and mounted on the wall it can serve other needs and uses such as the front covers on the box when completely closed can be provided with a magnetic or cork board to pin up pictures and notes. When the cover is first opened to a first position it can be used as a viewing screen or it can be made to have a coating to allow the use of writing with grease pencils or dry markers. If the dollhouse and its casement were removed from the inside storage area, additional uses of the unit can be made using various combinations of mirrors, tackboards, blackboards, shelves, dart games, to create a variety of other uses for the unit.

It is thus an object of this invention to provide a multiple purpose foldable wall mounted desk assembly which can be used as a desk, as a dressing table when a vanity insert is inserted in the storage cavity, as a play area when a dollhouse is stored in the cavity and unfolded on top of the desk top.

It is a still further object of this invention to provide a collapsible, convertible wall mounted desk assembly with brackets which can be adjusted to accommodate different widths between studs.

It is a still further object of this invention to provide a collapsible, convertible wall mounted desk assembly which has a drawer which when opened gives additional support to the desk top when it is opened.

It is still a further object to provide a collapsible convertible wall mounted unit to provide different heights for the desk top all with stability of leg extensions.

It is a still further object of this invention to provide a collapsible, convertible wall mounted unit which is portable and easily stored.

BRIEF DESCRIPTION OF THE DRAWINGS

FIG. 6 is a perspective view showing the back side of the embodiment shown in FIG. 1.

FIG. 6A illustrates the attachment of the shelf support frame to the drawer support frame.

FIG. 7 is a cross sectional view of a metal bracket mounting the back wall to a wall stud.

FIG. 8 shows an enlarged detailed view of the metal bracketing of FIG. 6.

FIG. 8A shows an alternate bracket to that of FIG. 8.

FIG. 9 is a view, partially in section, showing a metal mount for supporting the drawer and shelf from the box structure shown in FIG. 1.

FIG. 10 illustrates an exploded view of shelf dividers and slots in the top and bottom and sides of the embodiment of FIG. 2.

DETAILED DESCRIPTION OF THE INVENTION

Figure 1:
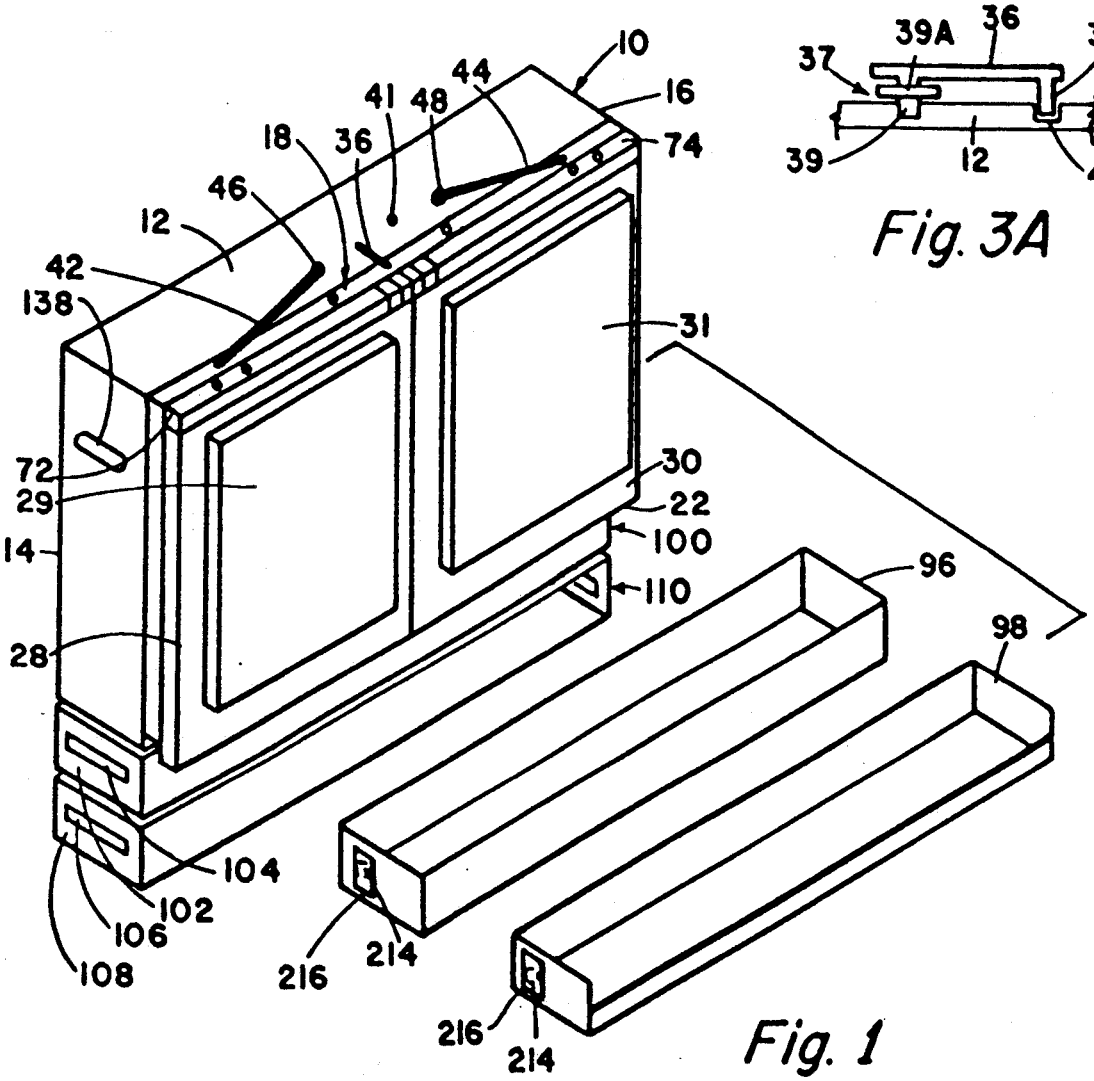
FIG. 1 is a perspective view of a compactly closed convertible desk assembly embodying the invention with drawer and shelf removed from their support frames.
Figure 4:
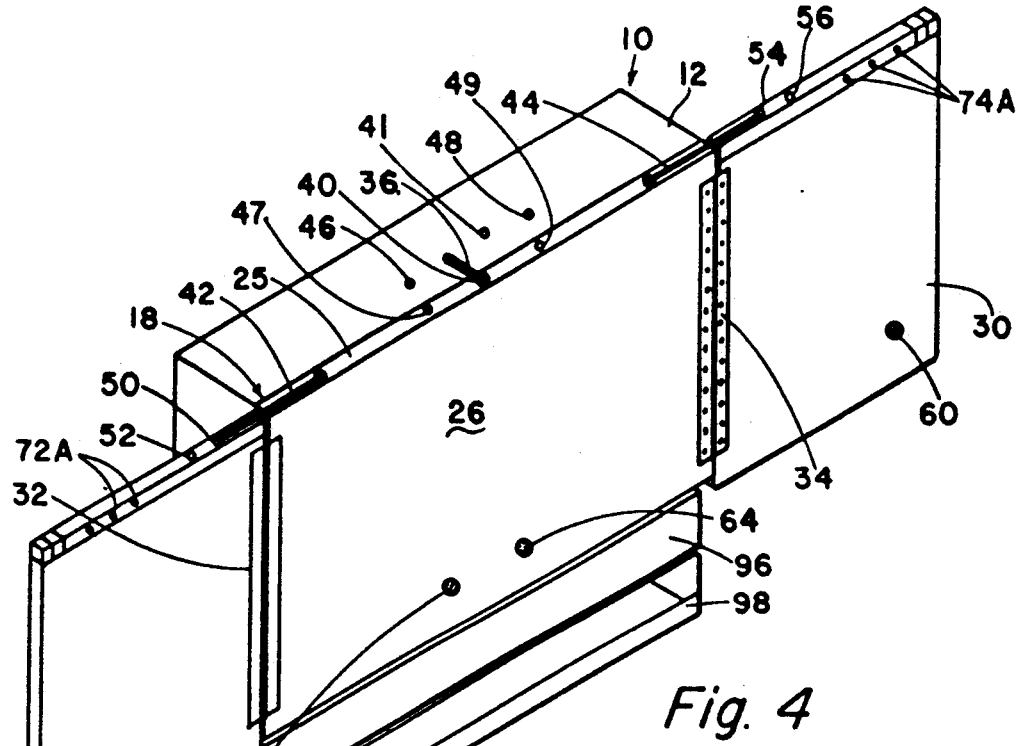
FIG. 4 is a perspective view of an apparatus embodying the invention and illustrates the initial step of opening the doors of the device of FIG. 1 in which the doors are open to form a plane with the bottom of the desk.
Figure 5:
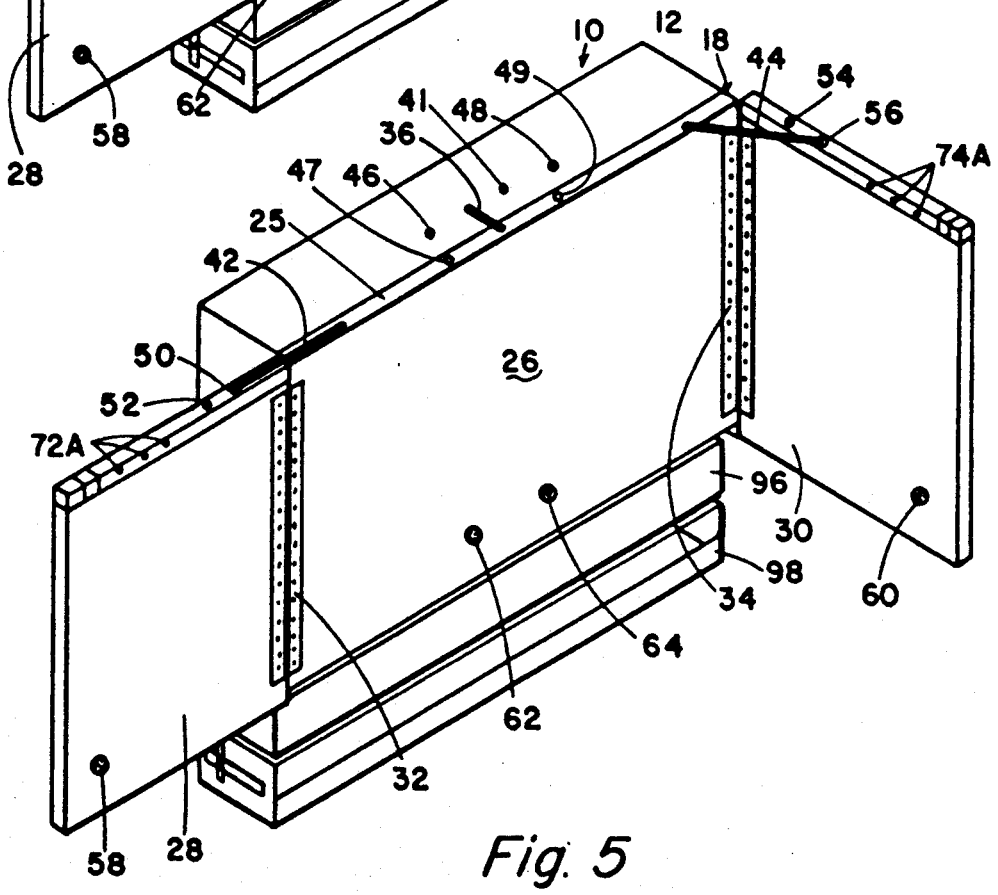
FIG. 5 is similar to FIG. 4 except one of the doors has been folded to a ninety degree position with respect to the desk top.
Figure 21:
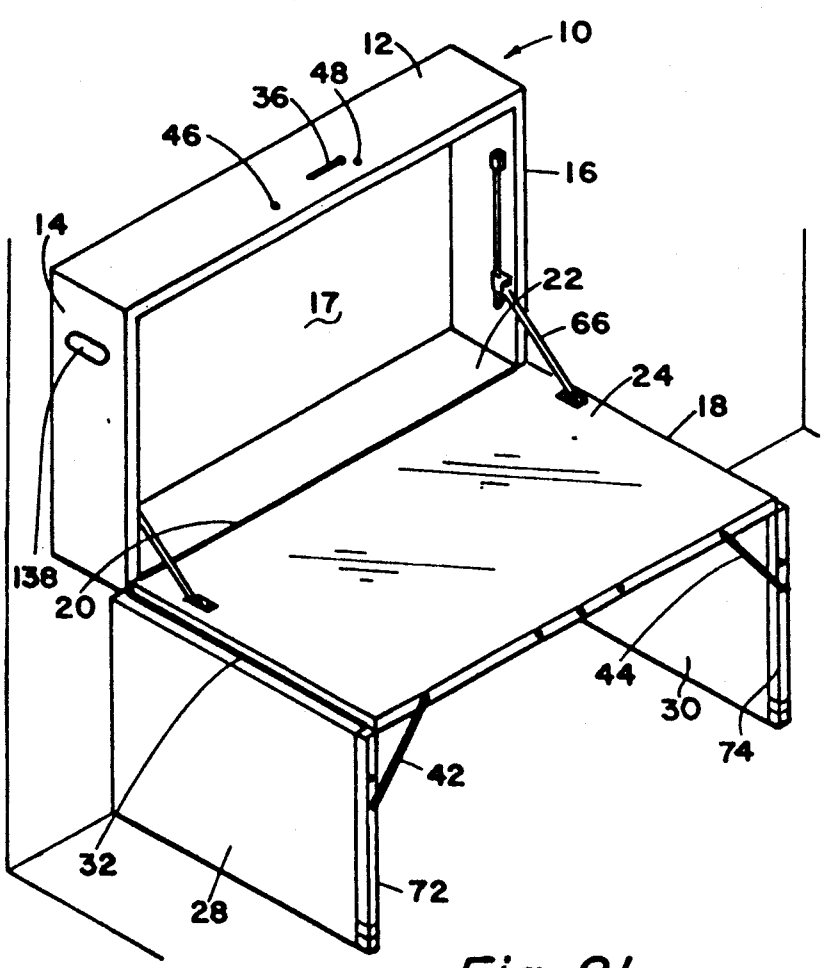
FIG. 21 illustrates the desk assembly in which the folding doors support the desk member from the floor and the box like storage cavity is empty.

Attention is first directed to FIGS. 1 and 21. FIG. 1 is a perspective view of the embodiment of my invention in which it is in a completely closed and portable position. FIG. 21 shows the embodiment as it would be supported from a wall and in an opened position with the desk member in place for use and the cavity within the assembly empty. FIG. 1 includes a box-like structure 10 having a top 12, a first side 14, and a second side 16 and bottom 22. It includes a desk member 18 which is hingedly attached along its lower edge by a hinge 20 to the bottom 22 of the box 10 as clearly shown in FIG. 9. The desk member 18 has a top side 24 and a bottom side 26 as shown in FIGS. 4, 5 and 9. Doors 28 and 30 are hingedly connected to desk member 18 by hinges 32 and 34, respectively. Utilitarian boards 29 and 31 such as cork board or magnetic panels, may be attached to doors 28 and 30. Alternatively, the outside of doors may be covered with cork, magnetic surface or decorative panels.

Figure 3A:
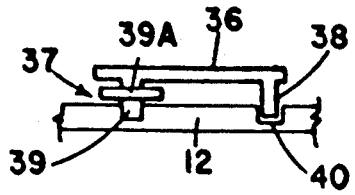
FIG. 3A illustrates one of the top latching brackets of FIG. 3.
Figure 3:
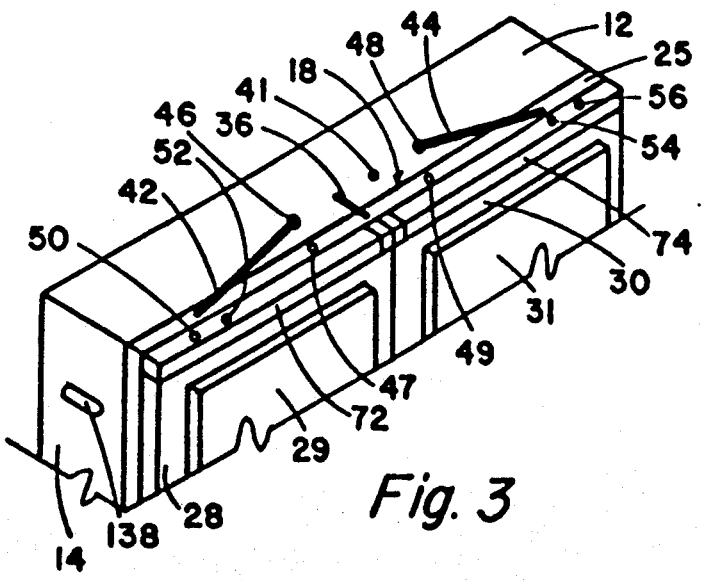
FIG. 3 illustrates the top of the desk assembly showing latching brackets.

As shown in FIG. 3, desk member 18, when it is in an upright position, is latched to top 12 by latching bracket 36. Bracket 36 is shown in more detail in FIG. 3A and includes a peg 38 and a pivot point 37 which may be a peg 39 with washer 39A. Peg 38 fits into securing hole 40 in the top edge 25 of desk member 18. When in the position shown in FIGS. 3, 4 and 5, the latching bracket 36 prevents the desk member from being folded down. When not in use, peg 38 fits into hole 41. The top edge 25 of desk member 18 is provided with two other latching brackets 42 and 44 which are similar to bracket 36. These brackets are pivotally attached to the top edge 25 of the desk member 18 and the peg portion of each, when the desk is in an upright position, fits into holes 46 and 48, respectively, in the top 12 of the box unit. This is a safety factor in addition to the latching bracket 36 to assist in holding the desk member 18 in an upright position. An alternate position for latching brackets 42 and 44 when not needed, are holes 47 and 49 in top edge 25 of desk member 18.

Sometimes it is desired to open the doors to the position shown in FIG. 4 so that the entire area of the inside of doors 28 and 30 and the bottom side 26 of the desk member 18 can be used as a large display screen area such as for projecting visual images or for writing with grease pencils. The top edge of door 28 has a first hole 50 and a second hole 52. Likewise, the top edge of the door 30 has a first hole 54 and a second hole 56. As will be seen, these holes are used to hold the doors in a desired position when they are opened. More specifically, in the position shown in FIG. 4, the doors 30 and 28 are opened so that they make 180° with the desk member 18. When in this position, the latching bracket 42 and 44 are in holes 50 and 54, respectively, so that the doors are held in the position shown in FIG. 4. Sometimes it is desired that the doors be held in a 90° relationship with the desk member 18. This is shown in FIG. 5 in which door 30 is in a 90° position and is held there by bracket 44 being in hole 54 of the top edge of the door. The position of these holes can be easily determined by simple calculations or by positioning the doors as desired and marking the location of the holes to be drilled. The securing holes for latching brackets 42 and 44 are calculated and positioned so that the brackets need only one peg to accommodate four latching positions. Likewise latching bracket 36 needs only one peg for two positions.

Additional means are also provided to hold the doors 28 and 30 in a closed position if latching brackets shown in FIG. 1 are released. This includes, as shown in FIG. 4, fasteners 58 and 60, such as Velcro, on the inside of the doors and complementary Velcro-like fasteners 62 and 64 on the bottom side 26 of desk member 18.

As shown in FIG. 21, there is a cavity within box 10 which can be seen when desk member 18 is lowered to the position that it would be in when being written upon. In order that the desk member 18 will not open too rapidly slow slide drop brackets 66 are provided. The top edge of each door 28, 30 is provided with an extension leg 68 and 70 respectively which are in housing 72 and 74, respectively. These legs and housings are provided with a plurality of button and hole releases 74A so that the leg can be extended to various lengths, varying from a height acceptable for a standing desk to the lowest setting for a small child. An additional extension 68A and 70A may be provided with extension legs 68 and 70. However, if the desk assembly is to be used by a small child it would be mounted on a wall at a height such that the doors 28 and 30 would rest on the floor and the leg extensions 68 and 70 would not be activated.

Attention is next directed to the means for attaching the portable desk assembly on a wall at a selected position. It is well known that the distance between studs which support the wall varies quite widely. I have a mounting system which can compensate for the various distances between studs. As clearly shown in FIGS. 6, 7 and 9, box back 17 is set in from top 12, sides 14 and 16 and bottom 22. That is, the back member 17 is set in with respect to the back edges of the top, bottom and sides of the box 10. Thus there is a top and bottom overhang as well as side overhangs. There is a slot 115 in the bottom side of top 12 for the box back member 17 and a slot 117 in the top of bottom of box member. Also slots 14A and 16A on the inside of left and right box members for back box member 17. This is shown clearly in FIG. 10. When one is ready to mount the box one determines the positioning or location of the studs and this is used to determine the position of brackets 76 and 78 which are spaced equidistance from the vertical center line of the back of the box so that the upper holes 80, 82 and lower holes 84 and 86 are at the proper position with respect to the wall studs. When brackets 76 and 78 are properly positioned, they are each secured to the box 10. This can be accomplished by directing screws 92 upwardly through the bracket and into the overhang of top 12 and screws 93 down into box bottom 22. As seen in FIG. 7, bracket 76 is such that the arms 94 and 95 are flush with the back edges of the top 12, bottom 22 of the box 10. Mounting bolts 90 and 91 are then placed into the studs at the proper location. There would be two on each stud which would correspond to the holes 80, 82, 84 and 86. FIG. 8A shows a slight modification to the bracket system, the bracket 76 could be in two parts, one would be the upper portion and the other a lower portion. There are four such mounting brackets. This modification is shown in FIG. 8A which shows a bracket 77 having a notch 79 for receiving bolt head 90 in secure position.

As indicated in FIG. 1 a drawer 96 and a shelf 98 can be readily mounted beneath the box 10. A metal drawer mount 100 is secured beneath the box 10. This is accomplished by use of a vertical flat bar 113 having a bolt receiving notch 113A which mates with the notch in bracket 76A. Vertical bar 113 is held to frame 100 by a bolt or screw 254 which extends through flat bar 113 and slot 212 which is in the back side of frame 100. The vertical bar 113 is moved along slot 212 until its slot 113A coincides with the slot in bracket 76A. At that time screw or bolt 254 is then tightened to secure the vertical flat bar 212 in the proper position. A second vertical flat bar 111 is provided to secure bracket 78B to the back side of drawer support frame 100. This also includes a bolt 261 which is secured to the back of frame 100 by tightening the bolt 261 in slot 210. This arrangement permits the vertical flat support bar to be moved as required to mate with the bracket 78B. By latching or hooking the vertical flat support bars 113 and 111 over the same wall support screws 90 and 91 as are brackets 76A and 78A then the drawer support frame 100 is securely supported to the box 10.

If it is desired to place the shelf 98 beneath the drawer 96, an additional support frame 110 is provided. The shelf support frame is supported directly from the drawer support frame 100. The support means includes slots 218 and 220 in the back of shelf support frame 110. Flat vertical support bars 250 and 252 are provided. Bar 250 is attached to the back of drawer support frame 100 by bolts 256 which are secured through slot 212 of the back of the drawer support frame and by bolts 258 which extend through slot 218 to secure the bar 250 to the shelf support frame 110. A mating vertical support bar 252 is also provided with a top screw or bolt 260 and bottom bolt 262 which extends respectively through slot 210 in the drawer support frame 100 and in the slot 220 of the shelf support frame 100. Attention is now directed to FIG. 6A which shows additional means of securing drawer support frame 100 to shelf support frame 110. This includes holes 270 in the bottom of drawer support frame 100 and holes 272 in a top shoulder of shelf support frame 110. Securing means such as stop bolts 274 may be screwed through holes 270 and 272. This aids in stability of these two support frames.

Figure 1A:
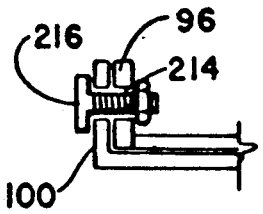
FIG. 1A illustrates drawer stops for the drawer of FIG. 1.

Attention is now directed to FIG. 1A which shows one means of providing drawer stops and shelf stops for the device of FIG. 1. A slot 104 is provided in end plate 102 of drawer support frame 100. Drawer 96 is provided with a threaded hole 214 in the end thereof. When drawer 96 is inserted into the frame 100, a bolt 216 having an enlarged head is placed through slot 104 and is screwed into hole 214. This then provides a stop for the drawer. A similar stop can be provided for shelf 98.

As shown in FIG. 21, box 10 has a large cavity or storage space behind the desk member 18 when in the upright or closed position. This unique arrangement of this storage space makes for a very versatile desk assembly. This can be used for storage, storage of a dollhouse, or can be used in converting the unit into a vanity. This can become a desk for use by students, kids, mom's, office or commercial uses. It can become a hobby center for artists, model builders, sewing center, fisherman tying flies, home handyman chores, kitchen desk or extra work space such as for a typewriter or computer table.

Figure 2:
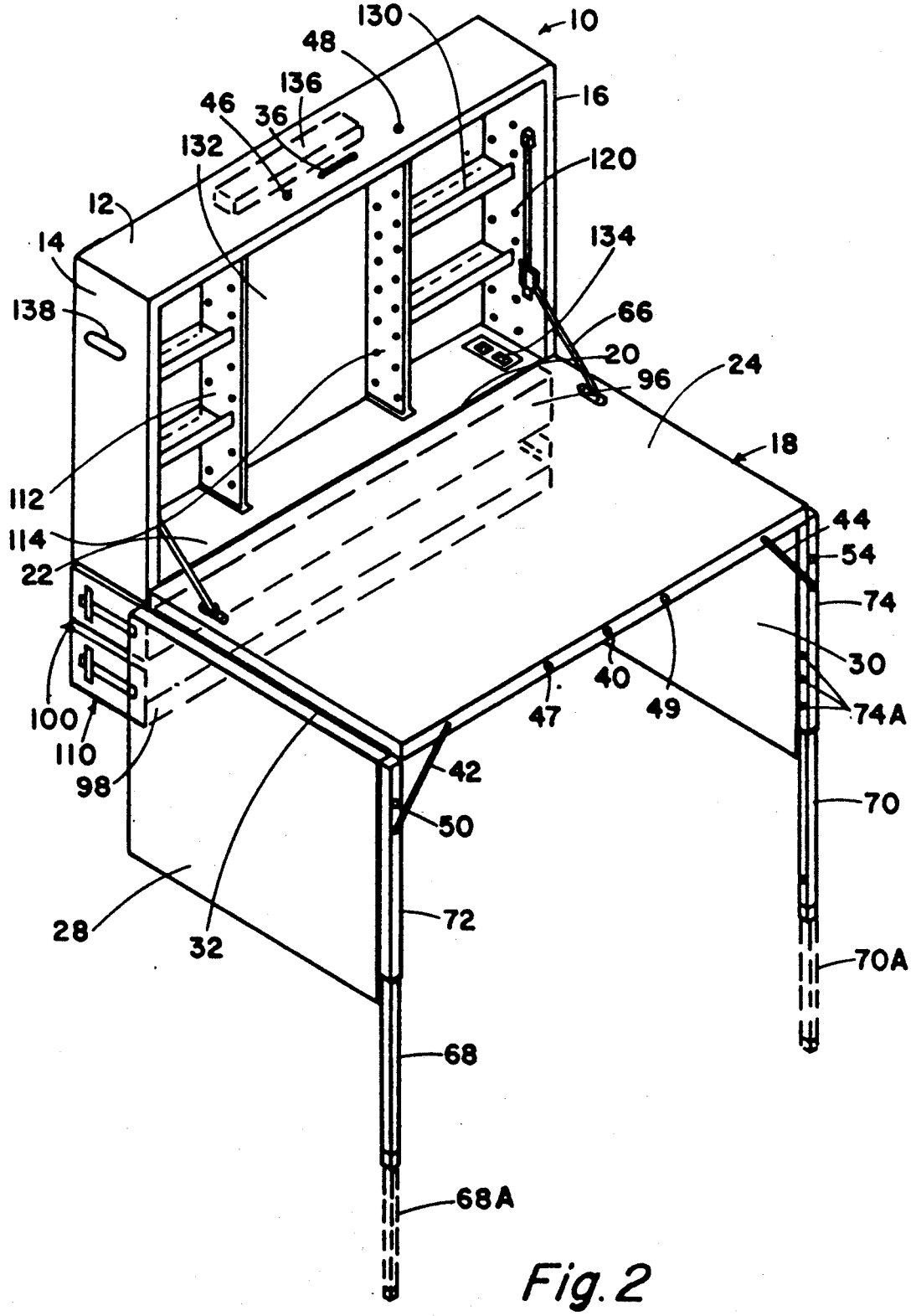
FIG. 2 is a perspective view showing a substantially completely assembled structure embodying the invention.

Attention is next directed to FIGS. 2 and 10 which shows how this cavity can be modified so that the entire assembly becomes a vanity. As shown in FIG. 10 there are two shelf dividers 112 and 114 with holes 116 and 118 drilled therein and holes 120 drilled in the interior walls of sides 14 and 16. Shelf dividers 112 and 114 are secured by means of grooves 122 and 124 in the underneath side of the top 12 and lower grooves 126 and 128 in the top of bottom 22. The grooves in the top are deeper than those in the bottom so as to allow easy removal of the dividers and yet when they are in place they are quite solid. The dividers length is such that they can be raised up to the top of groove 122 and 124 and clear bottom groove 126 and 128 and be easily removed. Horizontal shelves 130 can be provided between dividers and the sides. Shelf clips 109 are placed in the holes in dividers and side. S-shaped shelves 130 are placed on these shelf clips. The S-shape of shelves allow shelf to be secured behind back clips and upturned on front side of shelf. A mirror 132 can be secured to the center section of the back of the box. The dividers 112 and 114 may be cut so that a full mirror or other surface can be placed behind the dividers across the entire inside of the back surface 17 which is mounted on the wall allowing complete flexibility of inside arrangement of storage space. If desired electrical outlet 134 can be provided inside the box on bottom 22 or sides 14 or 16 and a light 136 can be provided in the top of the box. Further, end slots 138 can be provided to simplify the carrying of the box when it is desired to transport it from one location to another.

Figure 18:
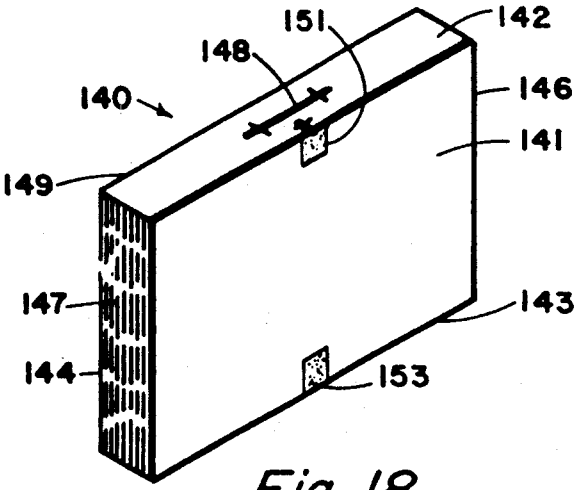
FIG. 18 illustrates the dollhouse in a carrying case.

Attention is next directed to the figures that illustrate the assembly of a dollhouse stored in the cavity of the box 10. The cavity is shown clearly in FIG. 21 and is available storage space. In the figures which I will now discuss there is a portable dollhouse folded up in a storage and carrying case 140 stored within the cavity. The dollhouse carrying case 140 is shown in FIG. 18. It has a front 141, a top 142 and two ends 144 and 146, bottom 143, and back 149. The dashed lines 147 indicates the various walls and sides of the collapsed dollhouse which is stored therein. A handle 148 is provided at the top so that the unit 140 as shown in FIG. 18 may be removed and carried independent of the desk assembly. In the interest of clarity, the drawer frame 100, shelf frame 110 and light 136 are not repeated in FIGS. 11, 12, 13, 14, 15, 16, 17 and 21.

Figure 12:
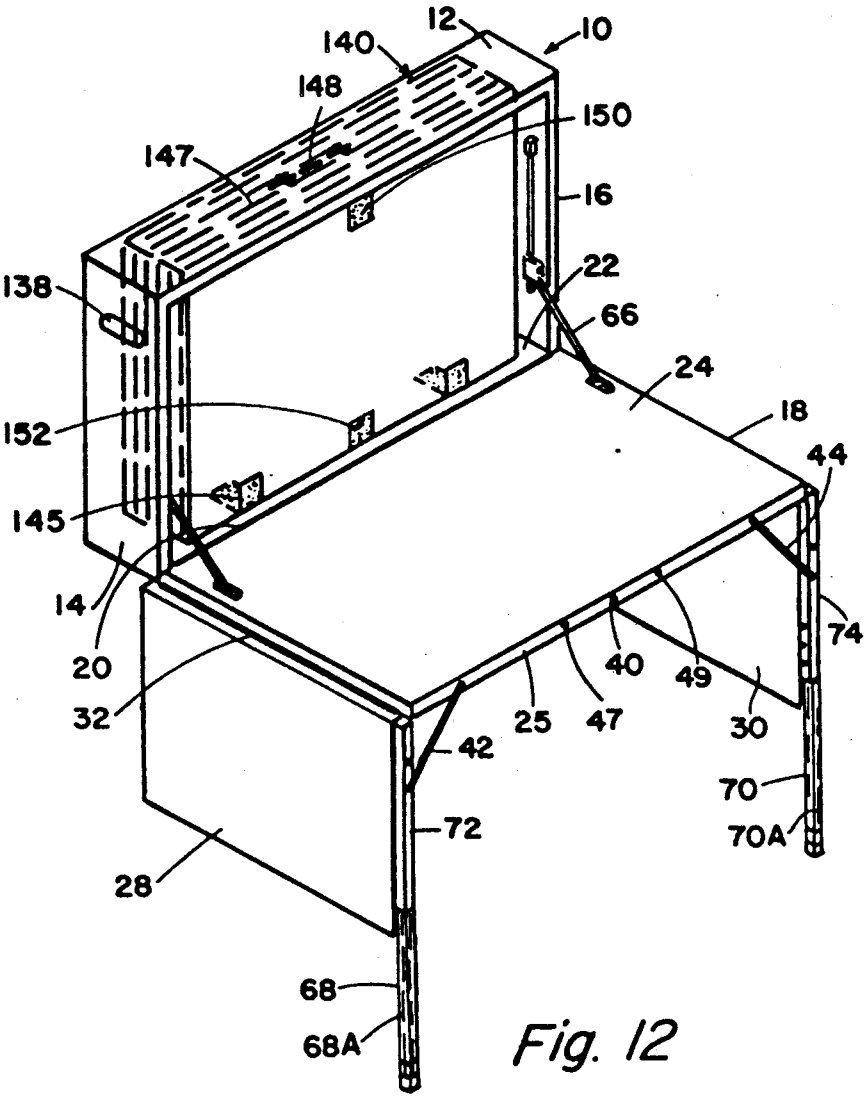
FIG. 12 is a perspective view of an embodiment similar to that of FIG. 11 except that it illustrates a dollhouse in place in the cavity or storage box area.
Figure 11:
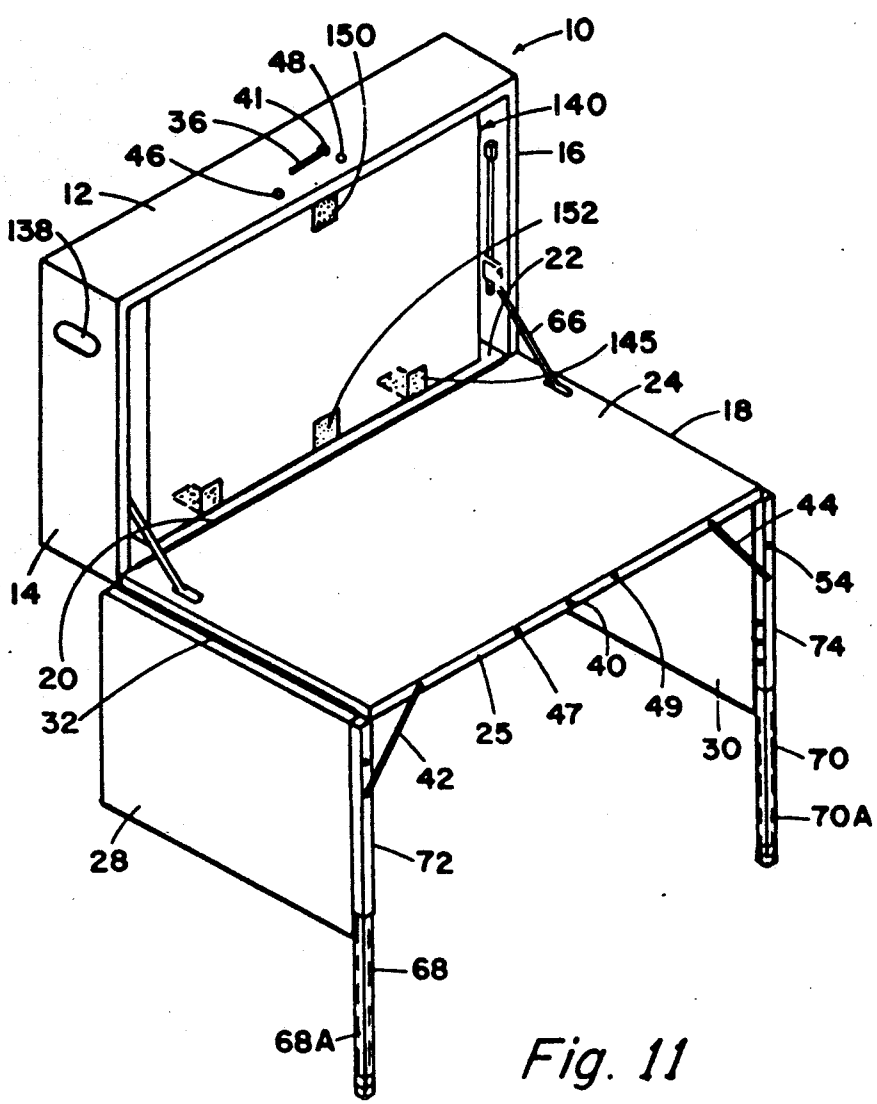
FIG. 11 is a perspective view showing the desk member such that extension legs support it from the floor.

Attention is next directed to FIG. 11 which shows the dollhouse carrying case 140 with the folded dollhouse within mounted in the storage cavity. It is secured in place by Velcro-like fasteners 150 at the top and 152 at the bottom which are also removable. Two complementary fasteners 151 and 153 on the front of carrying case 140. FIG. 12 is quite similar to FIG. 11 except that dashed lines 147 have been added to indicate the various planar elements of the sides, front, etc. of the folded dollhouse.

Figure 14:
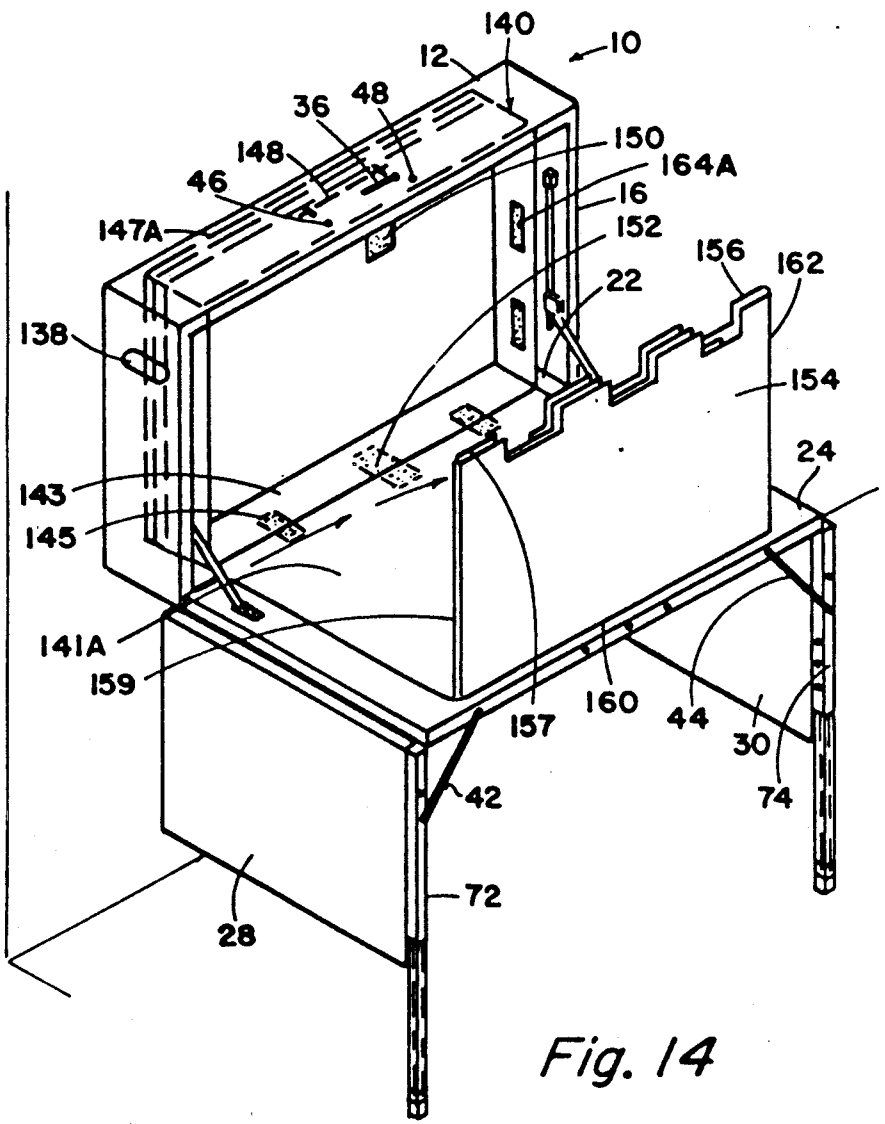
FIG. 14 is similar to FIG. 13 except it illustrates a succeeding step of erecting the dollhouse insert.
Figure 13:
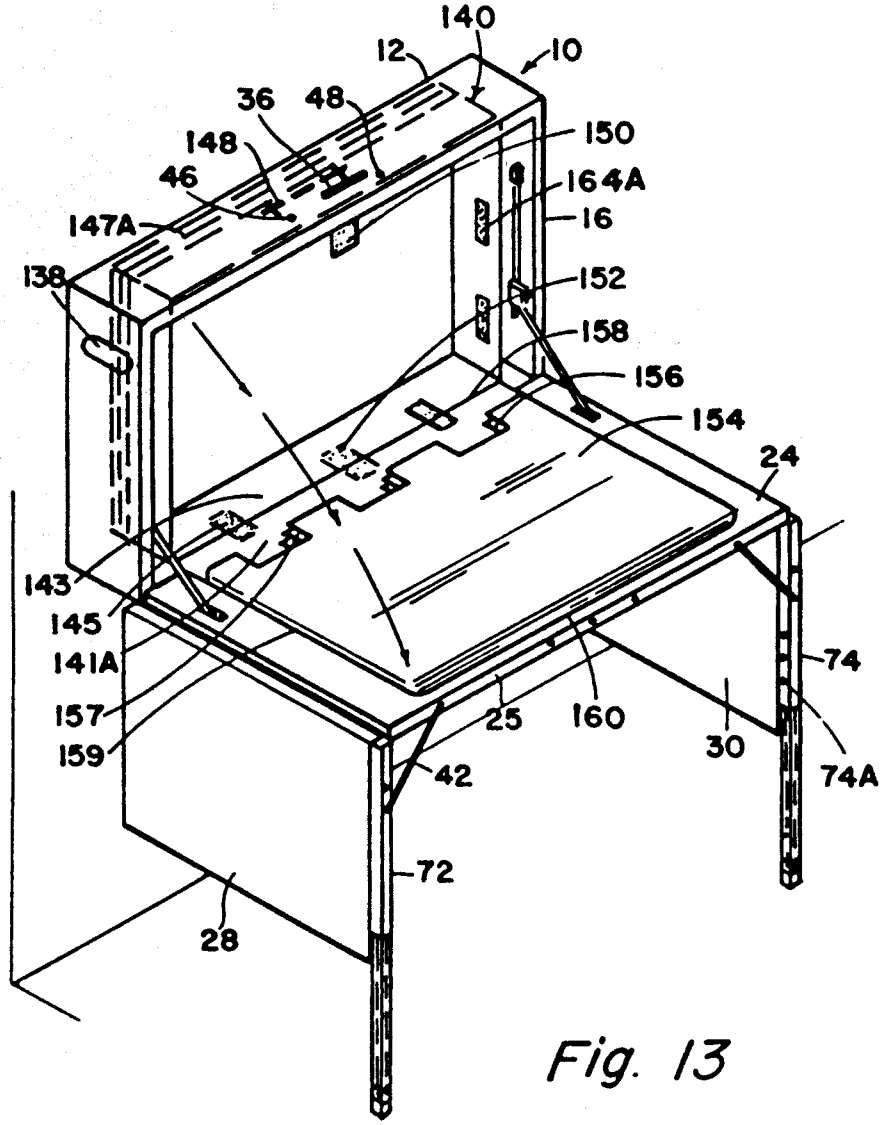
FIG. 13 is a perspective view similar to FIG. 12 but is the next sequence in which the dollhouse has been folded down flat on top of the desk member.
Figure 16:
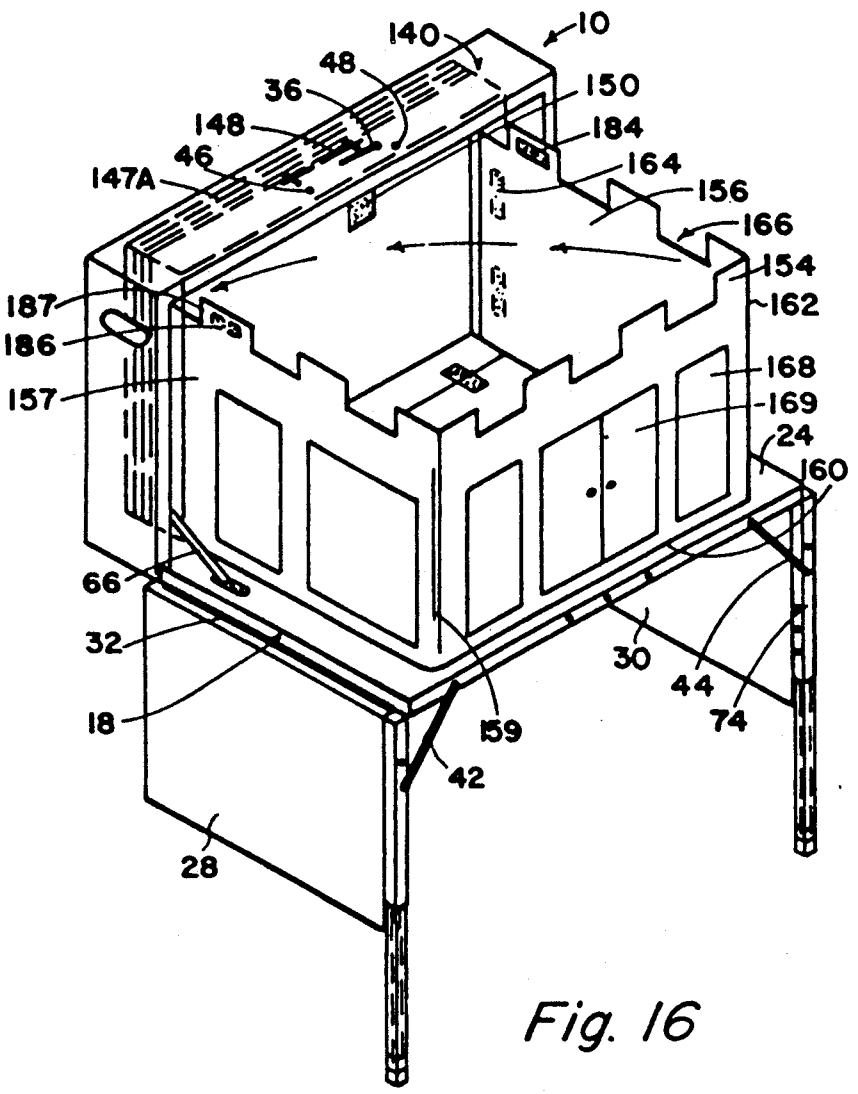
FIG. 16 is a perspective of a further sequence to the view of FIG. 15.
Figure 15:
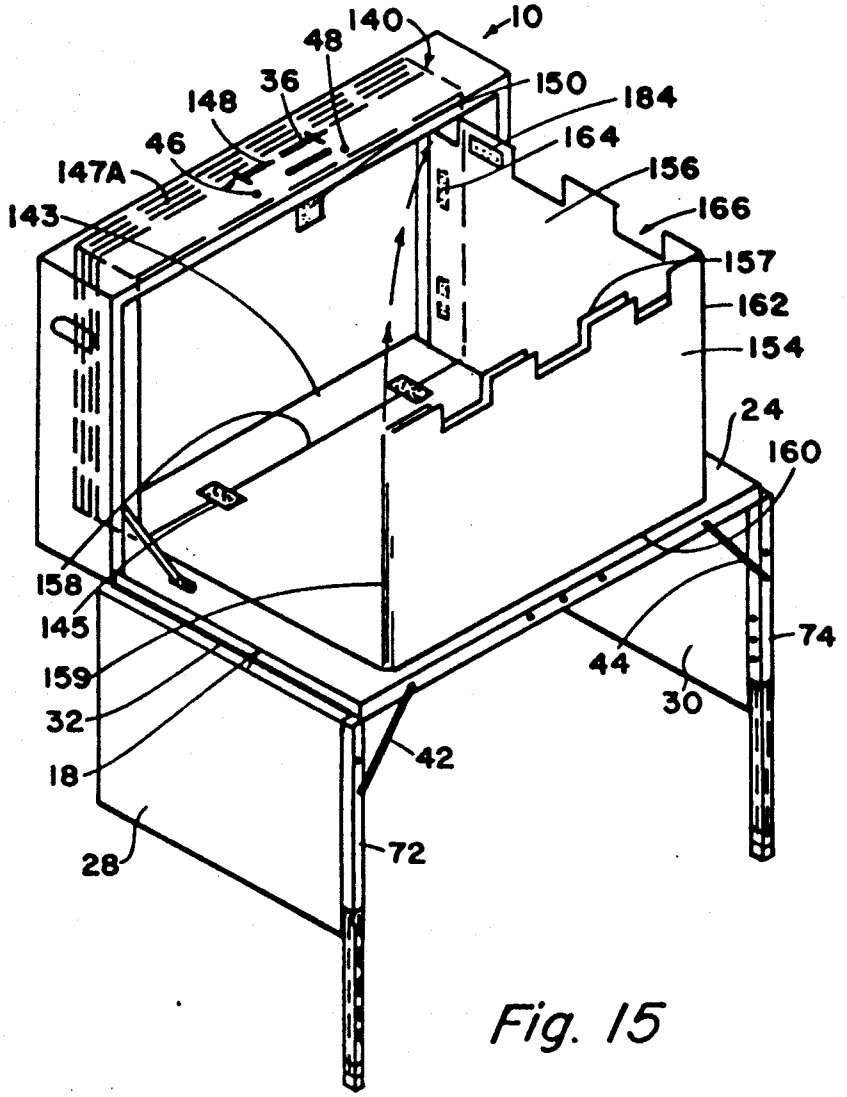
FIG. 15 is a view illustrating the next succeeding step.

Attention is now directed to FIG. 13 which shows the next sequence of events. Here the carrying case 140 has been opened and the front 141 is dropped forward at hinge line 158 down to the desk unit 18 top surface 24. The inside surface of the case front 141 now becomes the floor 141A of the dollhouse. The front side of the dollhouse 154 is shown hinged to the carrying case front 141 at hinge line 160. In FIG. 14 the side 154, which makes the front of the dollhouse, has been folded about hinge line 160 to an upright position. Dollhouse sides 156 and 157 are hinged to the dollhouse front member 154 at hinge lines 159 and 162 and are shown folded to a vertical, but not final position. In FIG. 15, side 156 has been folded about hinge line 162 to the position shown. Hinge line 162 is similar to hinge line 160 and they are both preferably just a crease in the material if a high grade cardboard or plastic is used. Side 156 is secured to the inside of carrying case side 146 by a fabric tape such as Velcro connections indicated by dotted lines 164 on side 156 and complementary connections 164A on case side 146. Dollhouse bottom 141 is secured to the bottom 143 of the dollhouse carrying case by Velcro fasteners 145. Attention is next directed to FIG. 16 in which side 157 has been rotated about hinge line 159 from side 154. Sides 154, 156, 157 each has a plurality of rectangularly shaped notches 166. As shown in FIG. 16, if desired, the sides 154, 156 and 157 can have windows 168 or other doors 169. Side 157 can be secured to the inside of the dollhouse carrying case similarly as side 156 was secured.

Figure 19:
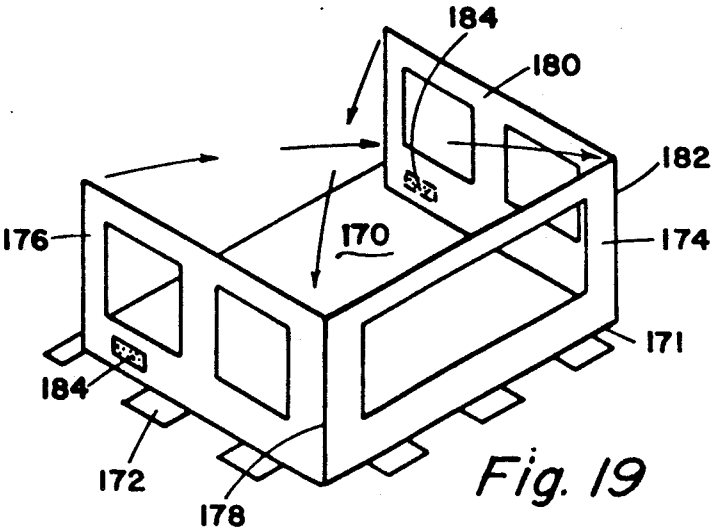
FIG. 19 shows the unfolded dollhouse second story.

This particular dollhouse shown has a second story. The second story is shown in FIG. 19. Shown thereon is a floor 170 with a plurality of tabs 172 which extend outwardly therefrom. It includes a front 174 to which a side 176 is hingedly attached at hinge line 178 and a second side 180 which is attached by hinge line 182 to front 174. The front 174 is hingedly attached to floor 170 at hinge line 171. Side 176 folds about hinge line 178 against the inside of front 174. Likewise, side 180 folds about hinge line 182 to the side of side 176. Then the two sides 176 and 180 and front 174 are folded down against bottom 170. Sides 176 and 180 have Velcro tabs 184 on the outside thereof which can be secured to tabs 186 which are secured to the inside of tab 187. Tabs 172 extend through the notches 166. Floor 170 then also becomes a ceiling or roof for the first floor of the dollhouse.

Figure 17:
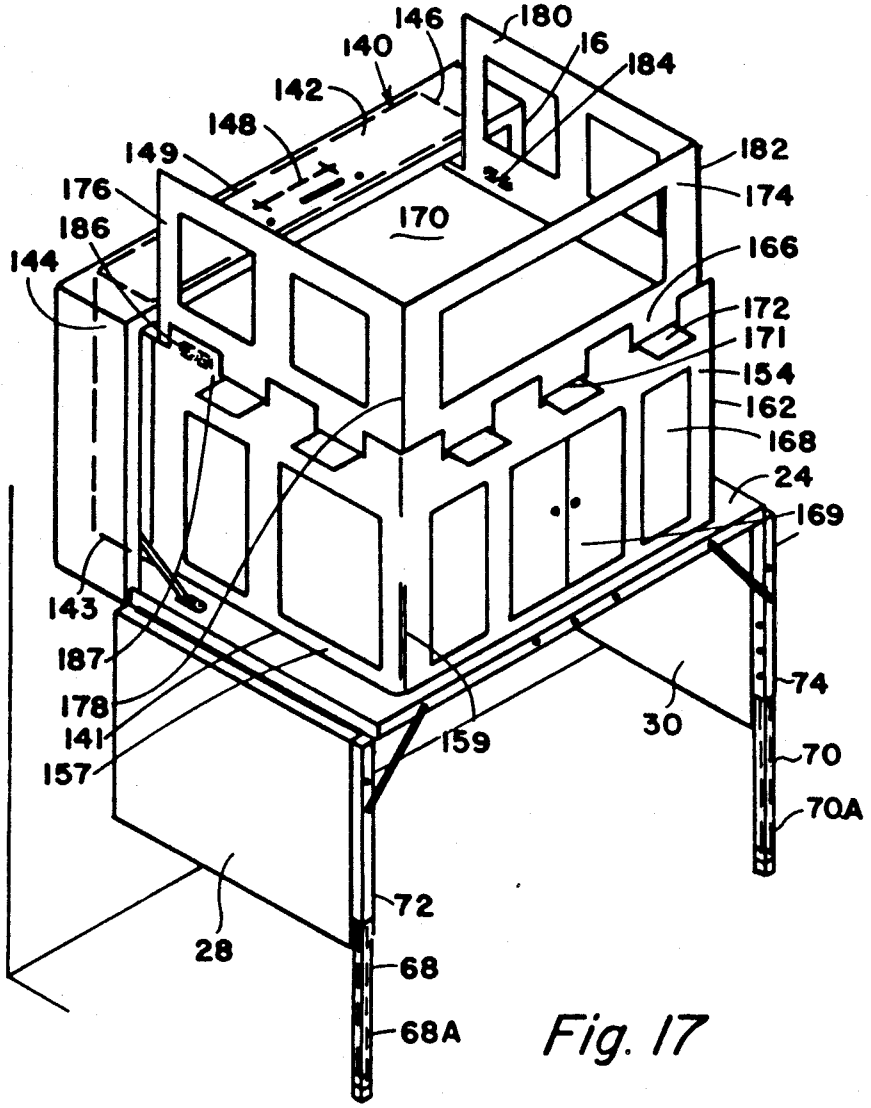
FIG. 17 is similar to FIG. 16 except that a second floor has been mounted on the dollhouse.
Figure 20:
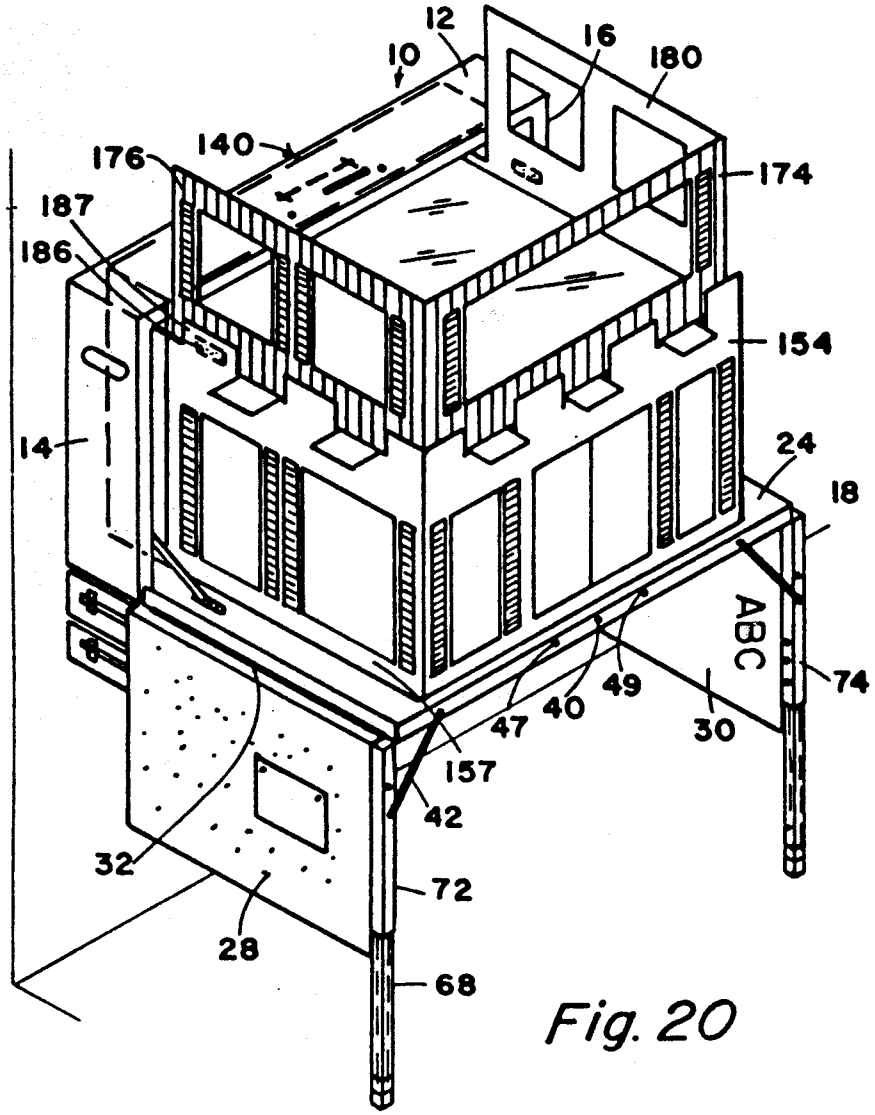
FIG. 20 illustrates a completely erected dollhouse with two stories with windows and external decorations thereon.

Attention is next directed to FIG. 20 which shows a dollhouse such as shown in FIG. 17 but with decorations with windows and doors and other items to give it an eye pleasing appeal to youngsters and adults alike.

It is seen then that this is a very versatile desk assembly that has a new and novel way of attaching it to the wall and especially to accommodate different distances between wall studs. The mounting of my unit is quite safe in that it is most difficult to knock it off of the wall.

I also have a unique way of mounting a drawer immediately beneath the cabinet. I mount it in such a way that when it is opened it helps support the desk member which will be used as a writing surface. I have also devised ways to open up the doors 28 and 30 so that they will be at 180° with the surface 26 of the desk member so that it will have a large display area covered by a plastic film upon which for example video displays can be made from a projector or an erasable writing grease pencil can be used. I can also, by using the bracket means I have disclosed, place these two doors at 90° angles with respect to the desk member 18 so that when the device is folded down as shown in FIG. 21 they will be resting on the floor and will support the desk member 18 with the doors 28 and 30 held firmly positioned at 90° by new support brackets. This would be the position for use by a small child. As a child grows, the desk unit would be raised mounting it higher on the wall and the extension legs 68 and 70 would be used. Thus, my unit can be adapted for different heights from the floor to accommodate different age or size people or for a standing desk if second extension legs are used 68A and 70A. It is useful in adjusting heights to accommodate wheelchairs for the handicapped.

This unit can be mounted on portable walls as well as permanent walls if the portable walls are suitably anchored and can be used in almost any room or garage of homes, mobile homes or boats or use in colleges, hospitals, offices, libraries and so forth. As shown above, this unit is clearly much more than something to hold a dollhouse. It can become a desk for use by students, children, mom's, offices, commercial uses and could even be a hobby center for artists, model builders, game center, sewing centers, fishermen tying flies, home handyman's chores or kitchen desk or a computer table or portable bar for home or office or a game center with dart board mounted inside center, etc. This unit has portability and easy storage which is also important.

The unit can also be recessed into the wall several inches if built in is required.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What I claim is:

1. A collapsible convertible desk assembly for attachment to a wall, which comprises:

a box-like storage cavity having a first and second side frame, a top frame, a bottom frame, each having a back edge, a back member mounted to said first and second side frame, said top frame and said bottom frame, at a distance from the back edge of each such that said top frame has a top overhang and said bottom has a bottom overhang;

attachment bracket means attached to the underside of said top overhang member and to the top side of said bottom overhang for attachment to said wall;

a single piece planar desk member having a flat work surface on one side and a flat opposite side, a first side edge, a second side edge, and a front and back edge, said back edge hingedly mounted to a front edge of said bottom frame;

a first door having a top edge that is hinged to said first side edge of said desk member;

a second door having a top edge that is hinged to said second side edge of said desk member, each of said first and second doors pivotal about said hinge between a first position which is parallel with said desk member and a second position which is at least 90° therefrom;

first and second latching bracket means to selectively retain said respective first and second doors in one of said first position or said second position; and including a collapsible dollhouse insert including storage/carrying case mounted in said storage cavity which is of sufficient size so that when said desk member is in its upper closed position the dollhouse insert is stored between said back of said storage cavity and said desk member, said dollhouse insert including a hingedly connected dollhouse back, a front wall, two end walls, and a floor, said front wall and end walls including openings representing windows and/or doors.

2. The assembly of claim 1 wherein a top of said front wall and two end walls of said doll house having notches therein;

a dollhouse second story having two sides and a front, said two sides and said front including openings representing windows, a bottom with tabs extending outwardly from said two sides and front thereof, said tabs corresponding in position to said notches to fit therein;

the second story front hingedly attached to said bottom, the first and second side members each hingedly attached to said second story front member;

means to fasten each side member to said first floor side members respectively.

3. The assembly of claim 2 wherein said means to fasten includes hook/loop fastener tabs on the lower outside portion of each said side member and complementary mating hook/loop fastener tabs on the inside of said first floor side members.

* * * * *